US009593541B2

(12) United States Patent
Ahola et al.

(10) Patent No.: US 9,593,541 B2
(45) Date of Patent: Mar. 14, 2017

(54) DRILL STRING COMPONENT

(71) Applicant: SANDVIK INTELLECTUAL PROPERTY AB, Sandviken (SE)

(72) Inventors: Petri Ahola, Gavle (SE); Johan Linden, Gavle (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/917,208

(22) PCT Filed: Aug. 27, 2014

(86) PCT No.: PCT/EP2014/068118
§ 371 (c)(1),
(2) Date: Mar. 7, 2016

(87) PCT Pub. No.: WO2015/032657
PCT Pub. Date: Mar. 12, 2015

(65) Prior Publication Data

US 2016/0208561 A1 Jul. 21, 2016

(30) Foreign Application Priority Data

Sep. 9, 2013 (EP) ..... 13183523

(51) Int. Cl.
*E21B 17/20* (2006.01)
*E21B 17/042* (2006.01)

(52) U.S. Cl.
CPC ..... *E21B 17/042* (2013.01); *E21B 17/0426* (2013.01)

(58) Field of Classification Search
CPC ..... E21B 17/042; E21B 17/00; E21B 17/10; E21B 17/16; E21B 17/0426; E21B 7/04; E21B 19/161
USPC ..... 138/109, 172, 177, 178, DIG. 11; 175/320, 325.1, 405, 415
See application file for complete search history.

(56) References Cited

U.S. PATENT DOCUMENTS 3,080,179 A * 3/1963 Huntsinger ..... E21B 17/00 138/155
4,256,518 A * 3/1981 Bolton ..... B23K 9/046 148/521
4,987,961 A * 1/1991 McNeely, Jr. ..... E21B 7/04 138/109

(Continued)

FOREIGN PATENT DOCUMENTS

WO 84/02158 6/1984

*Primary Examiner* — Patrick F. Brinson
(74) *Attorney, Agent, or Firm* — Corinne R. Gorski

(57) ABSTRACT

An elongate drill component for percussive drilling includes a female threaded end having an outer diameter (Dot), a male threaded end, and a central section between the ends having an outer diameter (Doc). The outer diameter of the female threaded end is larger than the outer diameter of the central section. A through-going flushing channel includes a central flushing channel having a diameter (Dic) and thread flushing channels having a diameter (Dit). The ratio of an elastic section modulus of a threaded joint measured when the female threaded end is connected to the male threaded end of an identical component to an elastic section modulus of the central section, St/Sc, is more than 1.5 and in that a ratio of the diameter of the central flushing channel to the outer diameter of the central section, Dic/Doc is between 0.45 and 0.95.

12 Claims, 4 Drawing Sheets

(56) References Cited

U.S. PATENT DOCUMENTS

| | | | | |
|---|---|---|---|---|
| 5,562,312 | A * | 10/1996 | Carlin | F16L 13/02 228/168 |
| 5,853,199 | A * | 12/1998 | Wilson | E21B 17/00 148/519 |
| 6,164,392 | A | 12/2000 | Larsson et al. | |
| 6,244,631 | B1 * | 6/2001 | Payne | E21B 17/042 285/333 |
| 6,681,875 | B2 | 1/2004 | Larsson et al. | |
| 7,900,719 | B2 * | 3/2011 | Yao | E21B 1/00 175/320 |
| 8,783,344 | B2 * | 7/2014 | Aung | E21B 17/10 166/241.1 |
| 9,222,314 | B2 * | 12/2015 | Mahmood | E21B 17/042 |
| 2005/0115717 | A1 * | 6/2005 | Hall | E21B 17/1035 166/380 |
| 2005/0189147 | A1 * | 9/2005 | Williamson | E21B 17/042 175/320 |

* cited by examiner

DRILL STRING COMPONENT

RELATED APPLICATION DATA

This application is a §371 National Stage Application of PCT International Application No. PCT/EP2014/068118 filed Aug. 27, 2014 claiming priority of EP Application No. 13183523.3, filed Sep. 9, 2013.

TECHNICAL FIELD

The present invention relates to percussive extension drilling and, in particular, to a drill string component for use in such drilling.

BACKGROUND

Extension drilling typically involves the use of a drill bit mounted at the end of a drill string which is both rotated and subjected to longitudinal impacts. The upper end of the drill string is connected to an above-ground drilling machine which performs the rotation and imparts the impact. Such a percussive drilling technique is commonly referred to as bench drilling. The present invention can also be used in, for example, long-hole drilling, drifting and tunneling.

A general description of percussive drill strings comprising rods are addressed in, for example, U.S. Pat. No. 6,164,392 and U.S. Pat. No. 6,681,875. These are examples of the most used type of drill string in percussive drilling. However, these rods tend to reduce the drilling speed and drilling accuracy, as well as increase the risk of the bit becoming stuck in the ground. Prior rods are prone to overheating and subsequent failure of the thread joints.

A drill string comprising tubes is addressed in European Patent Number 126740. Tubes in comparison to rods are tubular in shape, i.e. the wall thickness is small as compared to the diameter of the tube. With the known solution the flushing properties improve and the elastic section modulus is increased, compared to conventional drill rods, leading to improved drilling accuracy. However, the increased elastic section modulus of the tubes leads to higher stresses in the joints. This has the effect that the joints are difficult to break. The larger outer diameter of the tube, compared to conventional drill rods, decreases the gap between the drill string and the wall of the hole being drilled, leading to problems with transportation of cuttings from the hole.

The present invention combines the advantages of rods and tubes into a new component.

SUMMARY

One object of the present invention is to provide a threaded drill rod with improved stiffness.

Another object of the present invention is to provide a threaded drill rod with improved flushing.

According to an aspect, there is provided an elongate drill component for percussive drilling comprising a female threaded end having an outer diameter $D_{ot}$, a male threaded end, a central section between said ends having an outer diameter $D_{oc}$, wherein the outer diameter of the female threaded end is larger than the outer diameter of the central section; and a through-going flushing channel comprising a central flushing channel having a diameter $D_{ic}$ and thread flushing channels having a diameter $D_{it}$, wherein the ratio of an elastic section modulus of a threaded joint measured when the female threaded end is connected to the male threaded end of an identical component to an elastic section modulus of the central section, $S_t/S_c$, is more than 1.5 and wherein a ratio of the diameter of the central flushing channel to the outer diameter of the central section, $D_{ic}/D_{oc}$ is between 0.45 and 0.95.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
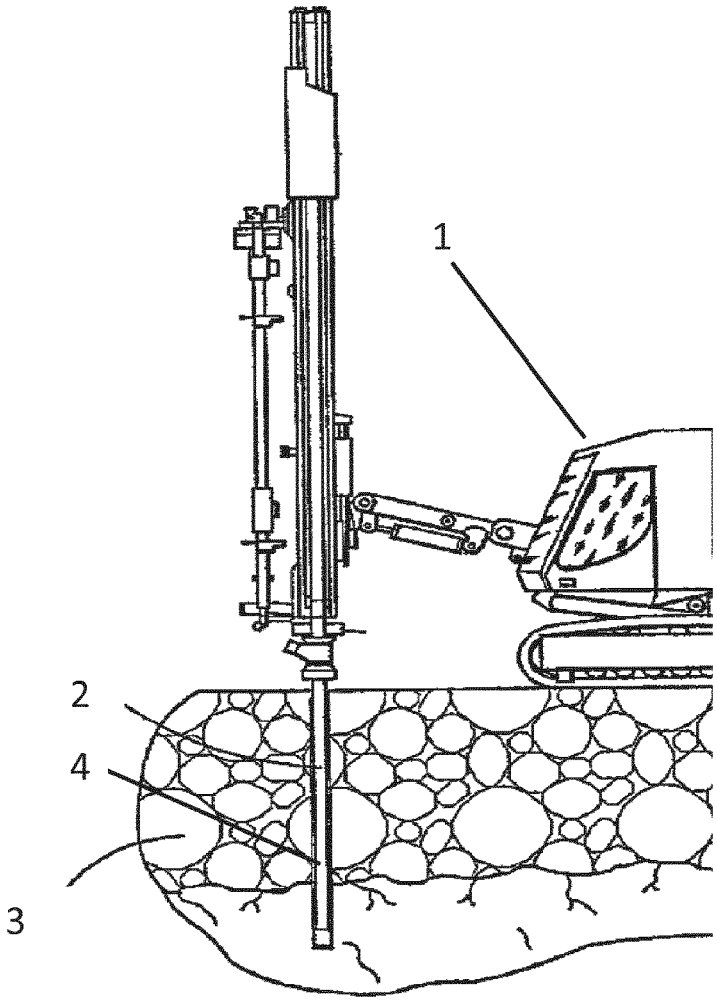
FIG. 1 schematically shows a prior art drilling machine for percussive top hammer drilling, in a side view.

FIG. 1 illustrates how a hole is made using a conventional bench drilling machine 1. A drill string 2 connected to a drill bit, is rotated and impacted into the rock 3, thus drilling a hole 4.

Figure 2:
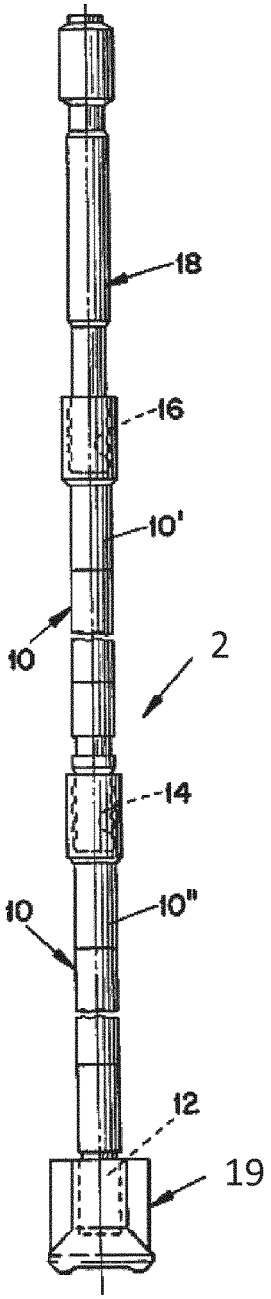
FIG. 2 schematically shows a prior art conventional drill string, in a side view.

FIG. 2 illustrates a conventional drill string 2 used for percussive drilling. The drill string 2 is connected to and extending from an adapter 18 at the drilling machine (not shown), and at least one rod 10 (but usually a series of rods) connecting the adapter to the drill bit. In a rod drilling machine, each rod 10 has a male screw thread 12 at one end and a female screw thread 14 at the other end. The uppermost rod 10' has its female thread 14 connected to a male screw thread 16 of the adapter 18. The remaining rods 10 are joined together in series. The lowermost rod 10" has its male thread attached to a female screw thread of a drill bit 19. The adapter 18 and the rods 10 have respective central passages extending therethrough and aligned with one another for conducting flushing fluid (usually water and/or air) which exits through outlets formed in a front face of the drill bit to cool the inserts and flush-away cuttings. The cuttings, along with the flushing fluid, are discharged upwardly through a gap formed between the drill string and the wall of the hole being drilled.

Figure 3:
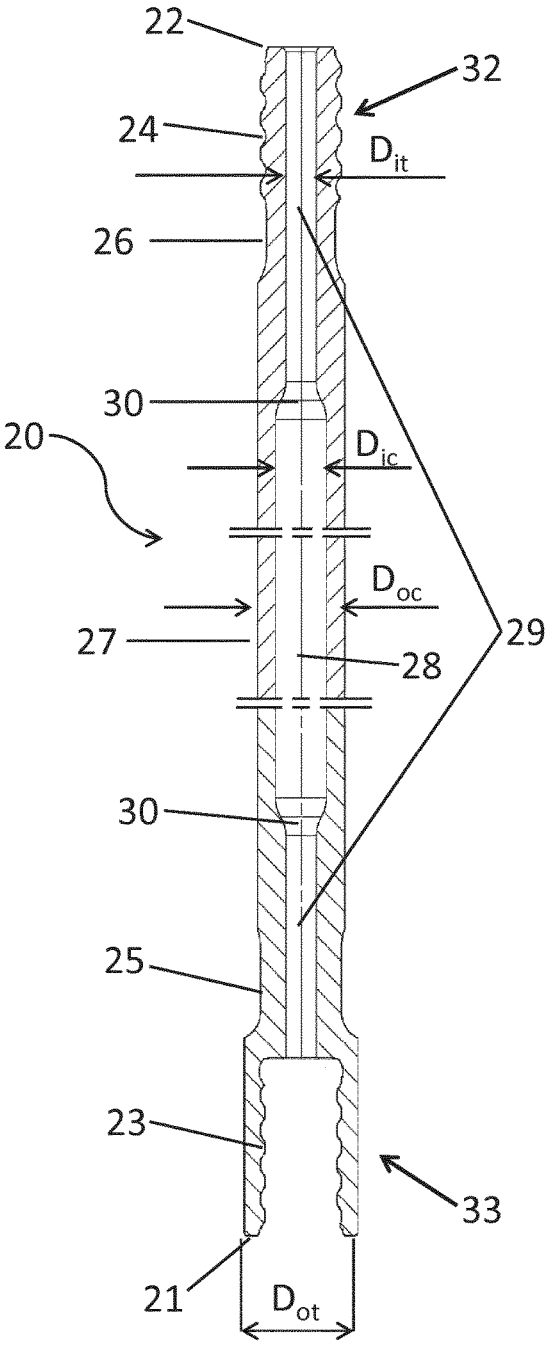
FIG. 3 schematically shows a longitudinal cross-section of an embodiment of the invention.

FIG. 3 illustrates an embodiment of the present invention. An elongate component 20 has an end 21 and an end 22. The end 21 has a female thread 23 and the end 22 has a male thread 24. The female thread 23 and the male thread 24 are cylindrical and comprise helical ridges and grooves and preferably have trapezoidal or rope geometries. The smallest radius of the female thread 23 and the male thread 24, in a cross-section along the longitudinal axis of the elongate component 20, is preferably larger than 1.5 mm.

Next to the end 21 the elongate component 20 has a slim section 25 with small outer diameter compared to the rest of the elongate component. Next to the end 22 the elongate component 20 has a slim section 26 with small outer diameter compared to the rest of the elongate component. Between the slim section 25 at the end 21 and the slim section 26 at the end 22 there is a central section 27. The outer diameter of the central section is larger than the outer diameter of the end 22 and smaller than the outer diameter of the end 21. The central section 27 of the elongate component 20 has an outer diameter $D_{oc}$. The end 21 has an outer diameter $D_{ot}$.

There is a through-going flushing channel in the centre of the elongate component 20. Flushing media like water and/or air are flushed in this channel in order to cool the elongate component and its joints and in order to remove cuttings from the drilled hole. The through-going flushing channel is divided into several parts, a central flushing channel 28 with a diameter $D_{ic}$ and thread flushing channels 29, at both the end 21 and the end 22, with a diameter $D_{it}$. Between the central flushing channel 28 and both thread flushing channels 29 there are steps 30 such that $D_{it}$ is smaller than $D_{ic}$. In order to have a smooth flow of the flushing medium the steps 30 are preferably smooth with no sharp edges.

The end 22, the male thread 24, the slim section 26 and a part of the central section 27 is preferably manufactured from a single piece of material into a male component 32. A ratio of the length of the male component 32 to the outer diameter, $D_{oc}$, of the central section 27 is between 3 and 5. The end 21, the female thread 23, the slim section 25 and a part of the central section 27 is preferably manufactured from a single piece of material into a female component 33. A ratio of the length of the female component 33 to the outer diameter, $D_{oc}$, of the central section 27 is between 3 and 5. The middle part of the central section 27 is preferably manufactured from a single piece of material. The male component 32 and the female component 33 may be manufactured from a different type of material than the middle part of the central section 27. The middle part of the central section 27 is preferably friction welded to the male component 32 and the female component 33.

Figure 4:
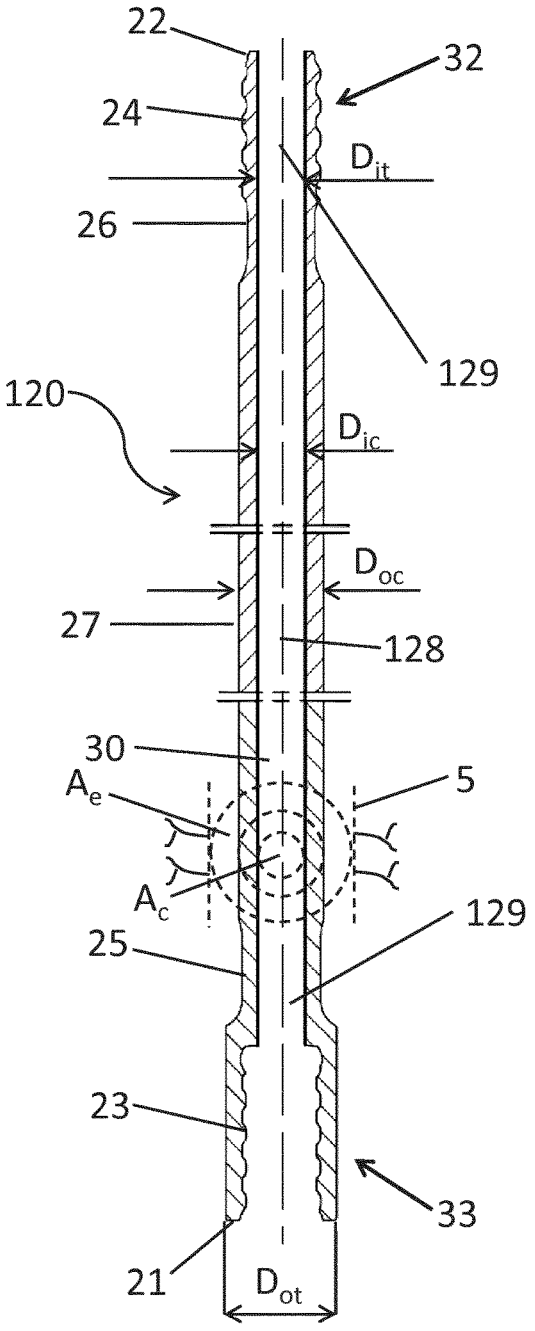
FIG. 4 schematically shows a longitudinal cross-section of an embodiment of the invention.

FIG. 4 illustrates an embodiment of the present invention. The elongate component 120 has a through-going flushing channel with substantially constant diameter from the end 22 to the female thread 23. This implies that the through-going flushing channel is continuous and stepless and the diameter, $D_{ic}$, of the central flushing channel 128 is substantially equal to the diameter, $D_{it}$, of the thread flushing channels 129.

The central flushing channel 128, with diameter $D_{ic}$ has a cross-sectional area $A_c$. An exit area $A_e$ for the cuttings to be flushed away from the hole 4, is formed between the central section 27 and the wall 5 of the hole 4. A ratio of the area $A_c$ of the central flushing channel 128 to the exit area $A_e$ is preferably between 0.04 and 0.26. This relationship between $A_c$ and $A_e$ ensures that there is sufficient space between the elongate component 120 and the wall 5 of the hole 4 for removal of cuttings from the hole 4.

Figure 5:
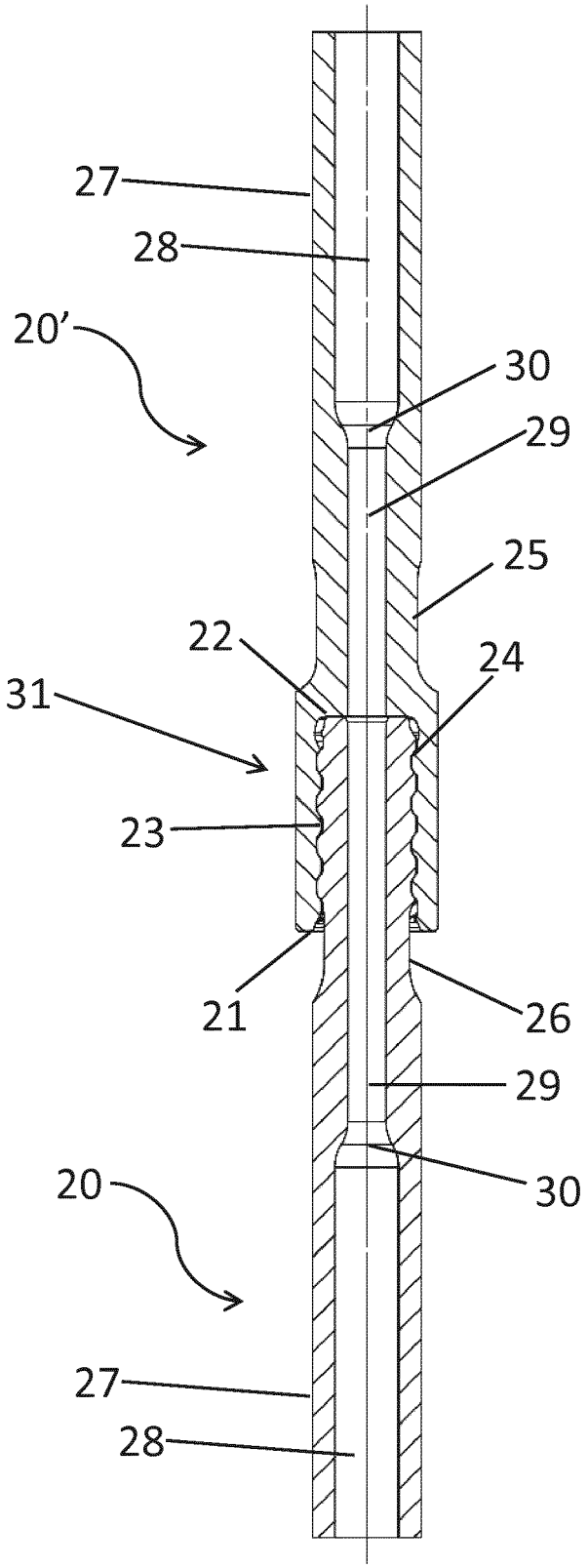
FIG. 5 schematically shows a longitudinal cross-section of an embodiment of the invention in a connected state.

FIG. 5 illustrates an embodiment of the present invention in a connected state. The male thread 24 of an elongate component 20 is screwed into the female thread 23 of another elongate component 20', thus connecting elongate component 20 with elongate component 20'. The interconnecting area between elongate component 20 and elongate component 20' forms a thread joint 31. In a drill string, several elongate components are connected in this way.

What characterizes the invention is the elastic section modulus of the thread joint 31 in relation to the elastic section modulus of the central section 27 in combination with the ratio between the diameter of the central flushing channel 28, 128 and the outer diameter of the central section 27. The elastic section modulus is a property that correlates to the bending resistance of a cross section perpendicular to the longitudinal axis of the elongate component 20.

The elastic section modulus, $S_t$, of the thread joint 31 is calculated using the following formula:

$$S_t = \frac{\pi * (D_{ot}^4 - D_{it}^4)}{32 * D_{ot}}$$

The elastic section modulus, $S_c$, of the central section 27 is calculated using the following formula:

$$S_c = \frac{\pi * (D_{oc}^4 - D_{ic}^4)}{32 * D_{oc}}$$

The ratio between the elastic section modulus's, $S_t/S_c$, is for the elongate component more than 1.5, preferably between 1.8 and 5.5 and more preferably between 2.0 and 3.5. This ratio is for known drill rods between 1.8 and 3.2 and for known drill tubes between 1.0 and 1.4.

The ratio between the diameter of the central flushing channel 28,128 and the outer diameter of the central section 27, $D_{ic}/D_{oc}$, is for the elongate component between 0.45 and 0.95, preferably between 0.48 and 0.75 and more preferably between 0.5 and 0.65. This ratio is for known drill rods between 0.25 and 0.42 and for known drill tubes between 0.55 and 0.75.

Figure 6:
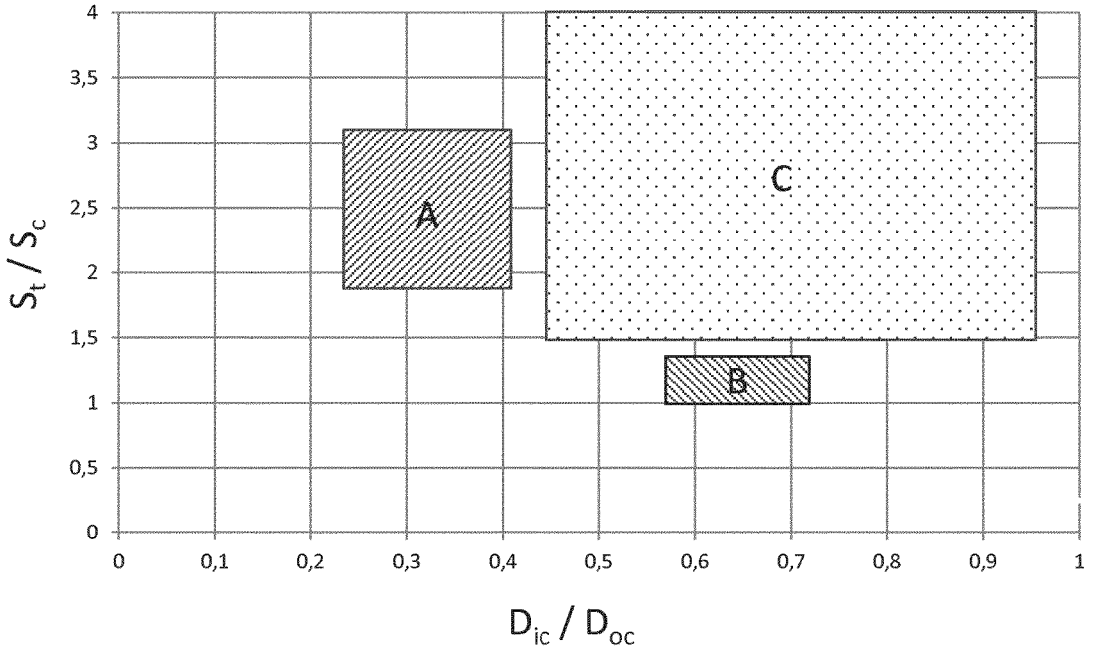
FIG. 6 shows a chart illustrating ratios of elastic section modules and ratios of inner and outer diameter of the invention compared with prior art.

FIG. 6 illustrates a graph of $S_t/S_c$ versus $D_{ic}/D_{oc}$. Known drill rods are located in area A, known drill tubes are located in area B and elongate components, according to the present invention, are located in area C. Note that area C extends to infinity in the $S_t/S_c$ direction.

Utilizing this specific combination of $S_t/S_c$ and $D_{ic}/D_{oc}$ gives certain advantages to the drill string. The large diameter of the central flushing channel 28,128, in relation to the outer diameter of the central section 27, gives good flushing properties which improves the removal of cuttings and cools the threads in the elongate component 20. Cooling of the threads increases the lifetime of the threads and the drill rate can be increased. The space between the wall 5 of the hole 4 and the outer diameter of the central section 27 is large enough to enable sufficient flushing of the cuttings from the drilled hole 4. The high elastic section modulus of the thread joints, in relation to the elastic section modulus of the central section 27, implies that the drill string may bend without causing too high bending stresses in the thread joints. This improves the lifetime of the thread joints and makes it easier to break the threads between the elongate components.

Example Embodiments and Test Results

A surface drill rig was used to compare conventional so called T51 drill rods with an embodiment of the invention. Both the conventional T51 rods and the embodiment of the invention were manufactured from case hardened steel. The same type of threads and the same type of heat treatment were used for the T51 rods and the embodiment of the invention. The pressure drop along the length of the drill string was measured as a measure of the flushing efficiency. The following results were obtained.

| | $D_{oc}$ (mm) | $D_{ic}$ (mm) | $D_{ic}/D_{oc}$ | $S_t/S_c$ | Pressure drop (Bar) |
|---|---|---|---|---|---|
| Conventional T51 rod | 52.0 | 21.5 | 0.41 | 2.6 | 4.2 |

-continued

| | $D_{oc}$ (mm) | $D_{ic}$ (mm) | $D_{ic}/D_{oc}$ | $S_t/S_c$ | Pressure drop (Bar) |
|---|---|---|---|---|---|
| Embodiment of invention | 56.4 | 31.0 | 0.55 | 2.1 | 2.3 |

It is evident that the pressure drop is much smaller for the invention compared to the conventional rod.

The lifetime of drill strings were compared while drilling in an underground mine. Conventional so called T45 rods were compared with an embodiment of the invention. Both the conventional T45 rods and the embodiment of the invention were manufactured from case hardened steel. The same type of threads and the same type of heat treatment were used for the T45 rods and the embodiment of the invention. The following results were obtained.

| | $D_{oc}$ (mm) | $D_{ic}$ (mm) | $D_{ic}/D_{oc}$ | $S_t/S_c$ | Lifetime (drilled meters) |
|---|---|---|---|---|---|
| Conventional T45 rod | 45.8 | 17.0 | 0.37 | 2.6 | 1800 |
| Embodiment of invention | 48.3 | 28.3 | 0.59 | 2.4 | 3800 |

It is evident that the lifetime of the invention is at least 100% longer than for the conventional rod.

The present invention is not limited to the above described embodiments. Different alternatives, modifications and equivalents might be used. The above mentioned embodiments should therefore, not be considered limiting to the scope of the invention, which is defined by the patent claims.

The invention claimed is:

1. An elongate drill component for percussive drilling comprising:

a female threaded end having an outer diameter (Dot), a male threaded end having an outer diameter, and a central section disposed between said ends, the central section having an outer diameter (Doc), wherein the outer diameter of the female threaded end is larger than the outer diameter of the central section and the outer diameter of the male threaded end is smaller than the outer diameter of the female threaded end; and a through-going flushing channel including a central flushing channel located in the central section, which communicates with a thread flushing channel located in each of the female and male threaded ends, the central flushing channel having a diameter (Dic) and the thread flushing channels each having a diameter (Dit), wherein the ratio of an elastic section modulus of a threaded joint measured when the female threaded end is connected to the male threaded end of an identical component to an elastic section modulus of the central section, St/Sc, is more than 1.5 and in that a ratio of the diameter of the central flushing channel to the outer diameter of the central section, Dic/Doc is between 0.45 and 0.95.

2. The elongate drill component as set forth in claim 1, wherein the ratio St/Sc is between 1.8 and 5.5.

3. The elongate drill component as set forth in claim 1, wherein the ratio Dic/Doc is between 0.48 and 0.75.

4. The elongate drill component as set forth in claim 1 wherein the ratio St/Sc is between 2.0 and 3.5.

5. The elongate drill component as set forth in claim 1, wherein the ratio Dic/Doc is between 0.5 and 0.65.

6. The elongate drill component as set forth in claim 1, wherein a through-going flushing channel surface includes steps, wherein Dit is smaller than Dic.

7. The elongate drill component as set forth in claim 1, wherein a through-going flushing channel surface is substantially continuous and stepless, Dit being substantially equal to Dic.

8. The elongate drill component as set forth in claim 1, wherein the ratio of a cross-sectional area Ac of the central flushing channel and a cross-sectional exit area Ae formed between said central flushing channel and a wall of a hole is between 0.04 and 0.26.

9. The elongate drill component as set forth in claim 1, wherein a female thread and a male thread are cylindrical threads having trapezoidal or rope geometries.

10. The elongate drill component as set forth in claim 9, wherein a smallest radius of the female or male thread, in a cross-section along the longitudinal axis of the elongate component, is larger than 1.5 mm.

11. The elongate drill component as set forth in claim 1, wherein a male component and a female component are attached to a middle part of the central section by friction welding.

12. The elongate drill component as set forth in claim 1, further comprising a slim section disposed between the female threaded end and the central section and between the central section and the male threaded end, the outer diameter of the slim section being smaller than the outer diameter of the central section, the female threaded end and the male threaded end.

* * * * *